US007013079B2

(12) United States Patent
Ito et al.

(10) Patent No.: US 7,013,079 B2
(45) **Date of Patent: *Mar. 14, 2006**

(54) HYBRID HOT AIR HEATER

(75) Inventors: Keiichi Ito, Aichi-ken (JP); Yoshinori Fujisawa, Aichi-ken (JP); Yukihiko Shimonoma, Aichi-ken (JP); Yoshimune Yamada, Aichi-ken (JP)

(73) Assignee: Rinnai Corporation, Aichi-ken (JP)

( * ) Notice: Subject to any disclaimer, the term of this patent is extended or adjusted under 35 U.S.C. 154(b) by 172 days.

This patent is subject to a terminal disclaimer.

(21) Appl. No.: 10/674,360

(22) Filed: Oct. 1, 2003

(65) Prior Publication Data

US 2004/0099749 A1 May 27, 2004

(30) Foreign Application Priority Data

Oct. 2, 2002 (JP) ..... 2002-289587

(51) Int. Cl.
*F24D 13/00* (2006.01)

(52) U.S. Cl. ..... 392/307; 392/365

(58) Field of Classification Search ..... 392/307, 392/310, 360–369, 379–384; 219/476–480; 237/12

See application file for complete search history.

(56) References Cited

U.S. PATENT DOCUMENTS

| | | | | |
|---|---|---|---|---|
| 5,937,139 | A * | 8/1999 | Peterson | 392/307 |
| 6,795,643 | B1 * | 9/2004 | Ito et al. | 392/307 |
| 2004/0103892 | A1 * | 6/2004 | Shimonoma et al. | 126/110 D |
| 2004/0109680 | A1 * | 6/2004 | Ito et al. | 392/307 |
| 2004/0151480 | A1 * | 8/2004 | Ito et al. | 392/307 |

FOREIGN PATENT DOCUMENTS

| | | | |
|---|---|---|---|
| FR | 2610089 | * | 7/1988 |
| FR | 2687899 | * | 9/1993 |
| JP | 55-63348 | * | 5/1980 |
| JP | 58-184431 | * | 10/1983 |

* cited by examiner

*Primary Examiner*—John A. Jeffery
(74) *Attorney, Agent, or Firm*—Arent Fox PLLC

(57) ABSTRACT

In a hybrid hot air heater according to the present invention, a chassis having first and second outlets 13 on its front face and first and second inlets 12 on its rear face incorporates therein a gas heater unit 2 comprised of a gas burner 20 and a first air-blowing fan 21 and an electric heater unit 3 comprised of an electric heater 33 and a second air-blowing fan 30 in such a manner that the air blowing systems for the respective two heaters may be independent of each other.

4 Claims, 3 Drawing Sheets

HYBRID HOT AIR HEATER

BACKGROUND OF THE INVENTION

1. Field of the Invention

The present invention relates to a hybrid hot air heater incorporating a gas heater and an electric heater into one chassis.

2. Description of the Related Art

A conventional hybrid hot air heater is disclosed in, for example, Jpn. Pat. Appln. KOKAI Publication No. 2000-9347. This conventional hybrid hot-air heater incorporates a combustion heater unit provided with a combustor that uses petroleum etc. as a fuel and an electric heater unit provided with an electric heater, into a chassis having an outlet on its front face and an inlet in its rear face. For this case, air-blowing systems for taking in combustion air from the room into the chassis and blowing out hot air heated at the respective heater units are controlled by one air-blowing fan provided at the rear of the chassis.

However, if the air blowing system for the combustion heater unit and that for the electric heater unit are controlled by one air-blowing fan, the generated heat quantity will be different between a case in which the electric heater is operated together with the combustion heater and a case in which the combustion heater is operated alone with the electric heater turned OFF. This means different quantities of intake air must be blown into the chassis in these different cases to prevent overheating. Different quantities of air are combusted in these different cases, thus making it difficult to operate the combustion heater with stability.

In view of the above, it is an object of the present invention to provide a hybrid hot air heater that can always operate a combustor of a combustion heater unit with stability irrespective of whether an electric heater unit is operating or not.

SUMMARY OF THE INVENTION

A hybrid hot air heater according to the present invention comprises a chassis having first and second outlets on its front face and first and second inlets on its rear face, wherein a gas heater unit comprised of a gas burner and a first air-blowing fan arranged below the gas burner that mixes combustion gas sent from the gas burner and air taken into the chassis through the first inlet and blows it out through the first outlet to the room, and an electric heater unit comprised of an electric heater that heats air taken in through the second inlet, and a second air-blowing fan that blows out the heated air through the second outlet to the room are incorporated into the chassis in such a manner that air blowing systems of the respective heater units may be independent of each other.

According to the present invention, since the air blowing systems for the respective gas heater unit and electric heater unit are incorporated into the chassis in such a manner that they may be independent of each other, the quantity of air taken into the gas heater unit can be made constant irrespective of whether the electric heater unit is operating or not. This creates a constant quantity of combusted air, thereby always operating the gas burner with stable combustion.

If the first and second air-blowing fans are operated simultaneously, they vibrate in resonance with each other at a resultant composite vibration frequency of the vibration frequencies of these air-blowing fans, thus increasing noise in some cases. In such a case, the operating noise of the hot air heater itself is increased causing a problem.

Therefore, to prevent resonant vibration during simultaneous operation of these first and second air-blowing fans, a vibration frequency changing means for changing the natural frequency is provided in at least one of these first and second air-blowing fans. It is thus possible to suppress the generation of noise of resonant vibration, thereby preventing the operating noise of the heater itself from being increased too loud.

For this case, the vibration frequency changing means is, for example, a casing in which the electric heater unit is housed, such that a motor of the second air-blowing fan might be fixed to this casing.

It is to be noted that the casing may be formed of resin having heat resistance, to facilitate a job of, for example, machining this casing into a complex shape.

DESCRIPTION OF THE PREFERRED EMBODIMENTS

Figure 1:
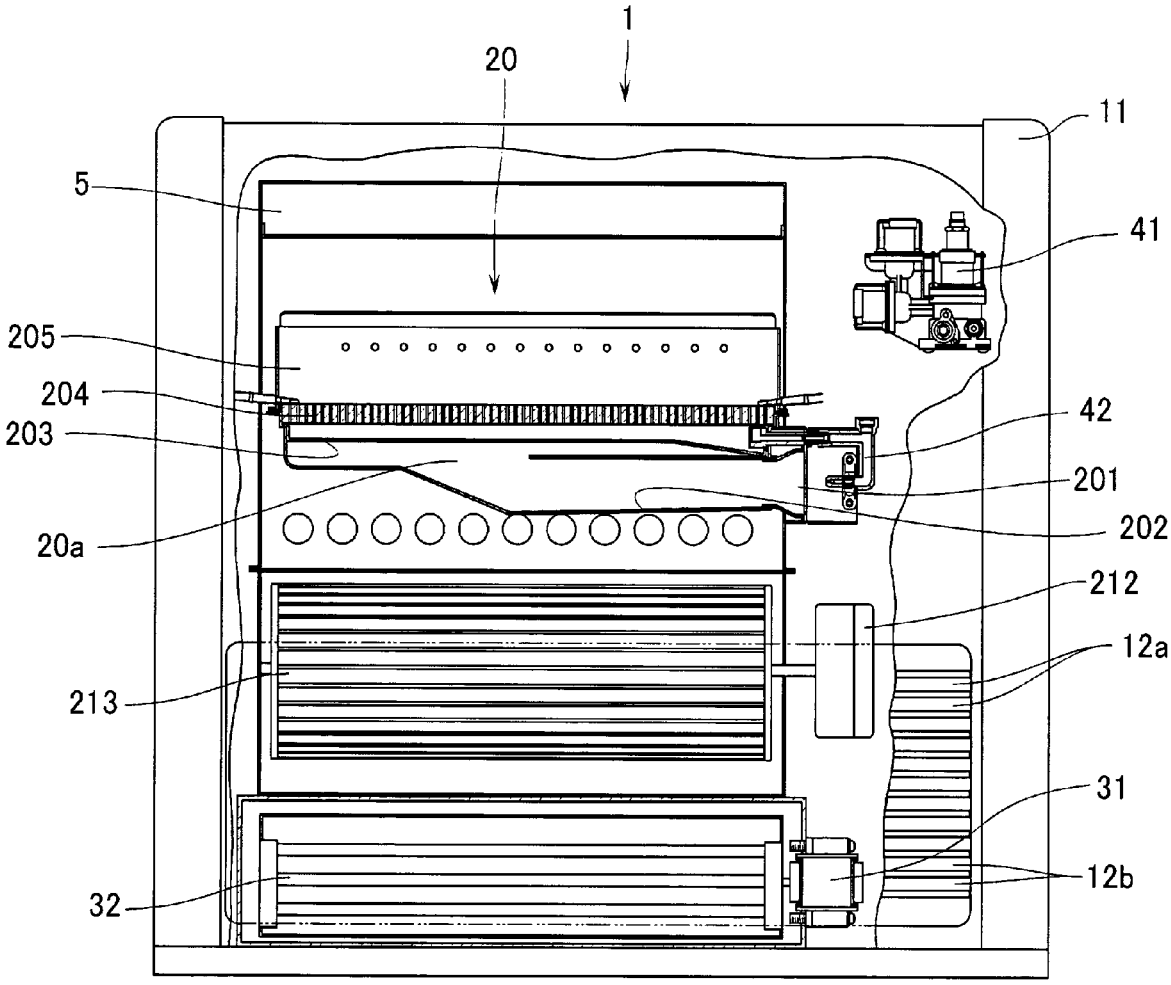
FIG. 1 is an explanatory front view of a configuration of a hybrid hot air heater according to the present invention.
Figure 2:
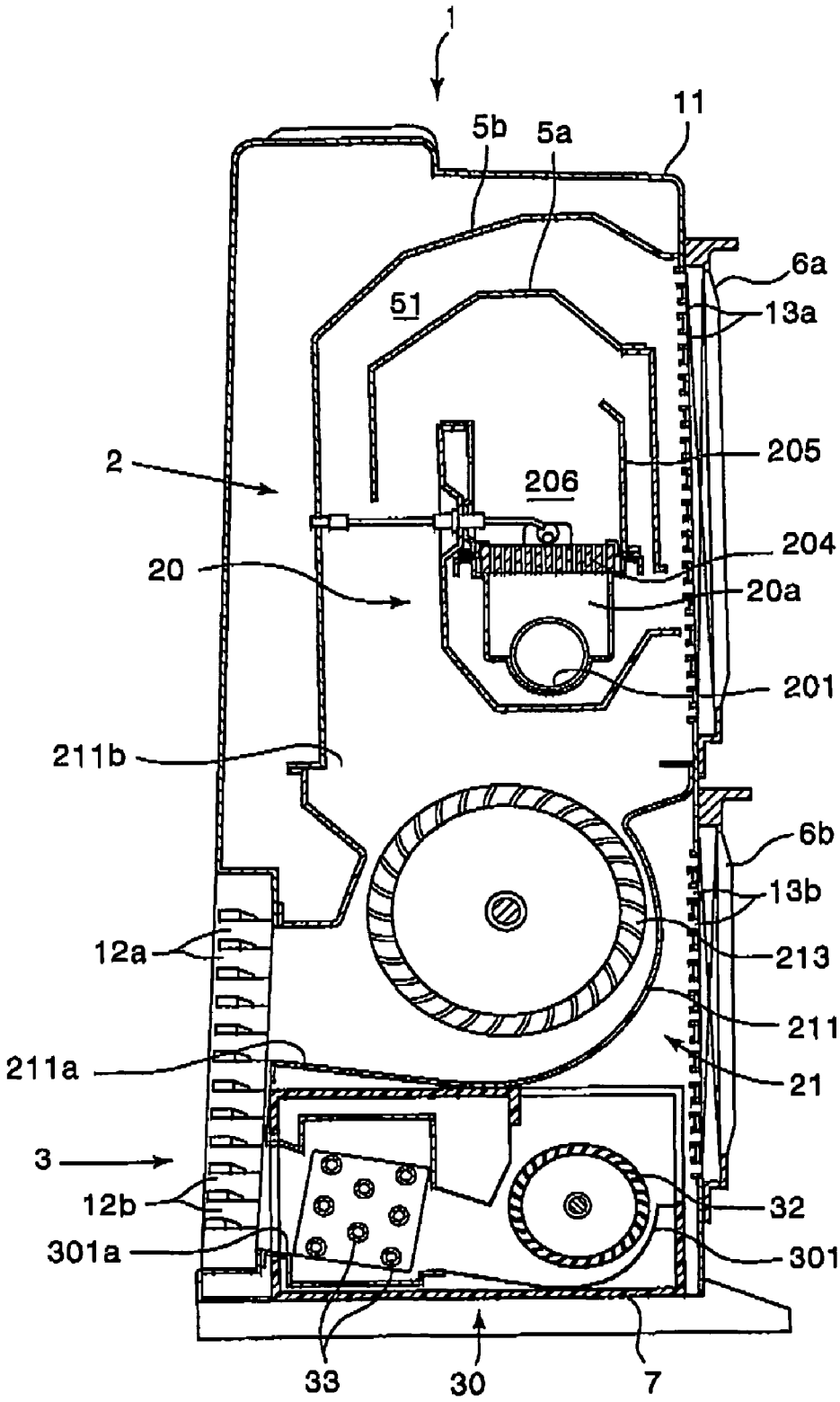
FIG. 2 is an explanatory vertical cross-sectional view of the configuration of the hybrid hot air heater according to the present invention.

As shown in FIGS. 1 and 2, reference number 1 indicates a hybrid hot air heater according to the present invention. This hot air heater 1 has a box-shaped chassis 11. In the chassis 11, a gas heater unit 2 and an electric heater unit 3 are incorporated at the upper part and the lower part, respectively.

According to the present embodiment, a first outlet 12*a* and a second outlet 12*b* are formed on the front face of the chassis 11 and a first inlet 13*a* and a second inlet 13*b* are formed on the rear face of the chassis 11 in such a manner that they may stand against the gas heater unit 2 and the electric heater unit 3, respectively. Here, as described later, two air-blowing fans are used to make air blowing systems for the respective gas heater unit 2 and electric heater unit 3 independent of each other.

The gas heater unit 2 comprises a gas burner 20 serving as a combustor and a first air-blowing fan 21 arranged below the gas burner 20 to supply it with combustion air. Fan 21 further mixes combusted gas and air that is sucked into the chassis 11 through the first inlet 13*a* and then blows out a mixture to the room.

The gas burner 20 is an all-primary combustion burner and has a burner body 20*a* including a fuel/air inlet 201 formed in the proximity of a gas spray nozzle 42 arranged at a tip of a gas tube (not shown) connected to a proportional valve 41 arranged in the chassis 11 and a mixer tube 202 that communicates with this inlet 201. A ceramic burner port plate 204 having a plurality of burner ports formed on it in a row is mounted to the opened upper face of the burner body 20*a* via a distribution plate 203 and is also covered by a combustion cover 205.

In this configuration, when the gas burner 20 has not been in service for a long period time and dust and dirt has accumulated in the inlet 201 blocking it excessively, if the gas burner is ignited, in the early stage of ignition (within about one minute from the time of ignition), the supplied air quantity will decrease to give rise to imperfect combustion, thus readily generating CO. If the hybrid hot air heater 1 is operated in such a condition, CO may be released to the room.

Figure 3:
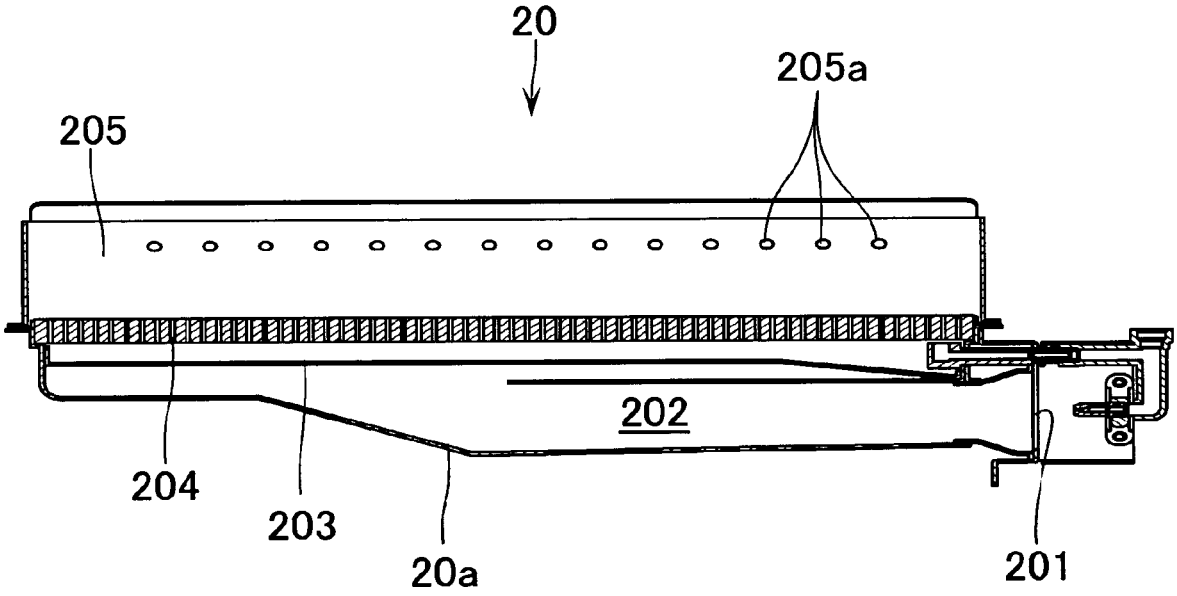
FIG. 3 is an explanatory expanded illustration of a gas burner.

Therefore, as shown in FIG. 3, at a predetermined position on the combustion cover 205, a plurality of secondary air vents 205*a* are formed in a row to take in secondary air into a combustion chamber 206 (see FIG. 2) covered by this combustion cover 205, thereby stabilizing the combustion condition of the gas burner 20 in the early stage of ignition.

In the chassis 11, a first partition 5*a* is provided in such a manner as to cover the combustion chamber 206 from above. Further, a second partition 5*b* is provided in the chassis 11 such that the gas burner 20 as well as the first partition 5*a* may be covered and that an air passage 51 leading to the first air-blowing fan 21 may be formed between itself and the first partition 5*a*. The first air-blowing fan 21 arranged below the burner body 20*a* has a housing 211 in which a fan duct 211*a* is formed leading to the first outlet 12*a*.

In the housing 211 is arranged a cross-flow type first moving vane 213 connected to a first motor 212 whose rotation speed can be controlled. In this configuration, the air passage 51 and an internal space of the housing 211 communicate with each other through an upper face opening 211*b* formed in the housing 211.

Thus, an air blowing system for the gas heater unit 2 is formed in such a manner as to lead from the first inlet 13*a* to the first outlet 12*a*. In this configuration, when the first motor 212 is driven to rotate the first moving vane 213, room air is taken into the chassis 11 through the inlet 13*a* and supplied to the inlet 201 in the burner body 20*a* and also through the air passage 51.

For this case, mixed air is supplied to the burner port plate 204 when combustion gas is sprayed to the inlet 201 through the gas spray nozzle 42. It is to be noted that an air/fuel ratio can be adjusted by controlling the first motor 212 to regulate the rotation speed of the first moving vane 213.

Combusted gas from the gas burner passes through an inside of the first partition 5*a* and is sucked toward the first air-blowing fan 21. Further, the air taken in through the first inlet 13*a* through the air passage 51 flows to an end of the first partition 5*a,* whereupon the combusted gas and the air are mixed and cooled and flow into the housing 211 through an opening 211*b*. Then, a mixed gas having a predetermined temperature is released into the room through the outlet 12*a*.

The electric heater unit 3, on the other hand, has a second air-blowing fan 30 that communicates with the second inlet 13*b*. This second air-blowing fan 30 has a housing 301 in which a fan duct 301*a* leading to the outlet 12*b* is formed. In this outlet a housing is arranged with a cross-flow type second rotation vane 32 connected to a second motor 31 whose rotation speed can be controlled. Further, the fan duct 301*a* is provided with eight seed heaters 33.

When hot air is blown out from the second outlet 12*b* of the electric heater unit 3, a floor of the room may be overheated by the hot air. Therefore, the fan duct 301*a* of the second air-blowing fan 30 is inclined upward.

Thus, an air blowing system for the electric heater unit 3 is formed in such a manner as to lead from the second inlet 13*b* to the second outlet 12*b*. In this configuration, when the second motor 31 is driven to rotate the second moving vane 32, room air is taken in through the inlet 13*b*. This air is heated as it passes through the seed heater 33 provided on the fan duct 301*a* and released into the room through the outlet 12*b*.

It is to be noted that the outlets 12*a* and 12*b* are formed adjacent to each other such that hot air blown out by the first air-blowing fan 21 and that blown out by the second air-blowing fan 30 may flow into each other. Further, the first and second inlets 13*a* and 13*b* are mounted with the respective anti-dust filters 6*a* and 6*b* to prevent dust and dirt from accumulating in the chassis 11.

If the first blowing fan 21 and the second air-blowing fan 30 are operated simultaneously, they vibrate in resonance with each other at the resultant composite frequency of the vibration frequencies of these air-blowing fans 21 and 30 thereby increasing the noise in some cases. In such a case, the operating noise of the hot air heater 1 is increased too loud. This is a problem.

According to the present embodiment, in order to prevent the first air-blowing fan 21 and the second air-blowing fan 30 from vibrating in resonance with each other when they are operated simultaneously, the electric heater unit 3 is housed in a casing 7 made of heat resistant synthetic resin and serves as a vibration altering means. Further, a housing 301 for the second air-blowing fan 30 is fixed to this casing 7 such that the natural vibration frequency of the second air-blowing fan 2 may be changed. It is thus possible to prevent the first air-blowing fan 21 and the second air-blowing fan 30 from vibrating in resonance when they operate simultaneously, thus suppressing noise and preventing loud operating noise. Further, the electric heater unit 3 having the independent air blowing system is housed in the casing 7. By removing this heater unit together with the casing 7, a stand-alone gas fan heater detached from the electric heater unit 3 can be easily formed.

What is claimed is:

1. A hybrid hot air heater comprising a chassis having first and second outlets on its front face and first and second inlets on its rear face, wherein:

a gas heater unit comprised of a gas burner and a first air-blowing fan arranged below said gas burner to mix combustion gas sent from said gas burner and air sucked into said chassis through said first inlet and blow it out through said first outlet into the room; and an electric heater unit comprised of an electric heater for heating air taken in through said second inlet and a second air-blowing fan for blowing out said heated air through said second outlet into the room;

are incorporated into said chassis in such a manner that air-blowing systems of the respective heater units may be independent of each other.

2. The hybrid hot air heater according to claim 1, wherein to prevent resonant vibration at the time of simultaneous operation of said first and second air-blowing fans, vibration frequency altering means for changing a natural frequency is provided in at least one of said first and second air-blowing fans.

3. The hybrid hot air heater according to claim 2, wherein said vibration frequency altering means is a casing in which said electric heater unit is housed, to which casing a motor of said second air-blowing fan is fixed.

4. The hybrid hot air heater according to claim 3, wherein said casing is made of resin having heat resistance.

* * * * *